US005327703A

United States Patent [19]

Cur et al.

[11] Patent Number: 5,327,703

[45] Date of Patent: Jul. 12, 1994

[54] VACUUM PANEL ASSEMBLY METHOD

[75] Inventors: Nihat O. Cur, Royalton Township, Berrien County; Richard W. Kruck, Sodus Township, Berrien County; David B. Kirby, St. Joseph Township, Berrien County, all of Mich.

[73] Assignee: Whirlpool Corporation, Benton Harbor, Mich.

[21] Appl. No.: 35,816

[22] Filed: Mar. 23, 1993

[51] Int. Cl.[5] ..... B65B 31/02; B32B 17/02

[52] U.S. Cl. ..... 53/434; 53/440; 53/449

[58] Field of Search ..... 53/434, 433, 432, 512, 53/511, 510, 440, 449, 127, 79, 408, 405, 403, 400, 170; 428/68, 69, 76; 220/422, 420

[56] References Cited

U.S. PATENT DOCUMENTS

| | | | |
|---|---|---|---|
| 4,636,415 | 1/1987 | Barito et al. | 428/68 |
| 4,662,521 | 5/1987 | Moretti | 206/484.2 |
| 4,681,788 | 7/1987 | Barto et al. | 53/434 X |
| 4,683,702 | 8/1987 | Vis | 53/433 |
| 5,009,318 | 4/1991 | LePinoy | 53/434 X |
| 5,076,984 | 12/1991 | Bisplinghoff et al. | 264/102 |

*Primary Examiner*—James F. Coan
*Attorney, Agent, or Firm*—Stephen D. Krefman; Thomas J. Roth; Thomas E. Turcotte

[57] ABSTRACT

A method for assembling a vacuum insulation panel is provided which includes the steps of: loading a quantity of microporous powder into a gas permeable pouch; pressing the pouch into a desired form; sealing the pouch; heating the powder to a temperature elevated above standard room temperature; inserting the pouch into a gas impermeable bag while the pouch and powder remain at the elevated temperature; evacuating gases from the powder pouch while it is at the elevated temperature; evacuating gases from the bag; and sealing the gas evacuated bag with the gas evacuated pouch therein to form a vacuum insulation panel. The heating of the powder may occur only just before insertion of the pouch into the bag, or may occur both before the powder is loaded into the pouch as well as just before insertion of the pouch into the bag. Further, a trace amount of Helium (at a pressure of approximately 1 mm Hg) may be put into the bag before it is sealed in order to permit testing of the sealed panel for leaks.

24 Claims, 8 Drawing Sheets

VACUUM PANEL ASSEMBLY METHOD

BACKGROUND OF THE INVENTION

The present invention relates to a vacuum panel assembly method, and in particular a method utilizing the powdered insulation material which is first inserted into a porous pouch and subsequentially sealed into an impermeable barrier bag.

Vacuum insulation panels are useful in a variety of environments, and in particular in conjunction with refrigeration apparatus in which they are utilized as insulating panels in the walls of refrigerators and freezers.

Typically a vacuum insulation panel has some type of insulating material, generally powders or microporous sheets of insulating material which are placed into an impermeable bag and, after evacuation of all gases, the bag is sealed. Such panels and a method for fabricating them are disclosed in U.S. Pat. No. 5,018,328, assigned to Whirlpool Corporation, the assignee of the present application, the disclosure of said patent being incorporated herein by reference, as well as in U.S. Pat. Nos. 5,076,984 and 4,683,702.

The use of a gas permeable enclosure to contain the powder during evacuation is disclosed in the '984 and '702 patents listed above. The use of multiple compartments in an insulation panel is disclosed in the '328 patent.

SUMMARY OF THE INVENTION

The present invention provides a method for assembling vacuum panels in a significantly improved process over other presently known processes.

Two embodiments of the invention are set forth herein. In a first embodiment, the microporous powder is initially heated and dried and transferred, under a dry nitrogen (or air) blanket, to a hopper. A vacuum filling machine is utilized to fill a microporous pouch with the powder from the hopper and to seal the pouch. The filled pouch is then reheated so that the powder is at an elevated temperature at the time that the pouch is then inserted into a partially formed panel. The panel then undergoes vacuum processing in which gases are removed from interior of the panel prior to a sealing of the panel. It has been determined that the reheating of the powder just prior to insertion of the pouch into the panel greatly reduces the time required for the vacuum processing of the panel, and/or permits a higher vacuum to be achieved within the panel given the same evacuation period as a non-reheated pouch. As an option, during the vacuum processing of the panel a very small and specific trace amount of helium (preferably below 1 mm Hg pressure so not to affect its superior thermal insulation characteristics) can be injected into the vacuum panel which is then immediately sealed in order to allow for helium leak testing of the panel as disclosed in copending application Ser. No. 635,489, filed Dec. 28, 1990, the disclosure of which is incorporated herein by reference.

In a second embodiment of the assembly method, unconditioned powder, which may have some level of moisture therein, is placed into a hopper. Vacuum filling of the pouch then occurs with this moisture laden powder and the pouch is sealed. Subsequently, the pouch is heated in an oven, preferably in a vacuum oven, to remove the moisture from the panel and then the pouch is inserted into the partially formed barrier bag while still at an elevated temperature. The panel then undergoes vacuum processing during which time gases are removed from within the panel and the panel is sealed as described above. Again, a small trace amount of helium may be optionally injected into the panel before sealing to be used for leak testing.

DETAILED DESCRIPTION OF THE PREFERRED EMBODIMENTS

Figure 1:
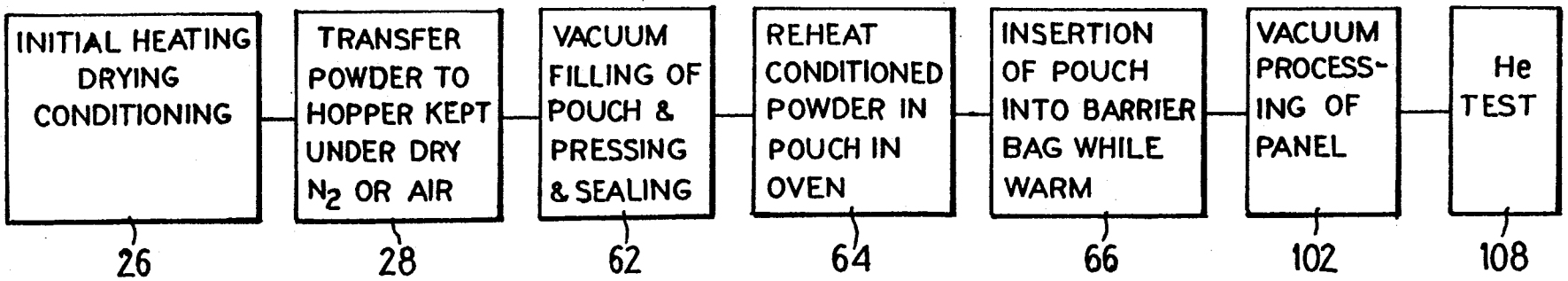
FIG. 1 is a flow chart schematically illustrating a first embodiment of the method of the present invention.
Figure 4:
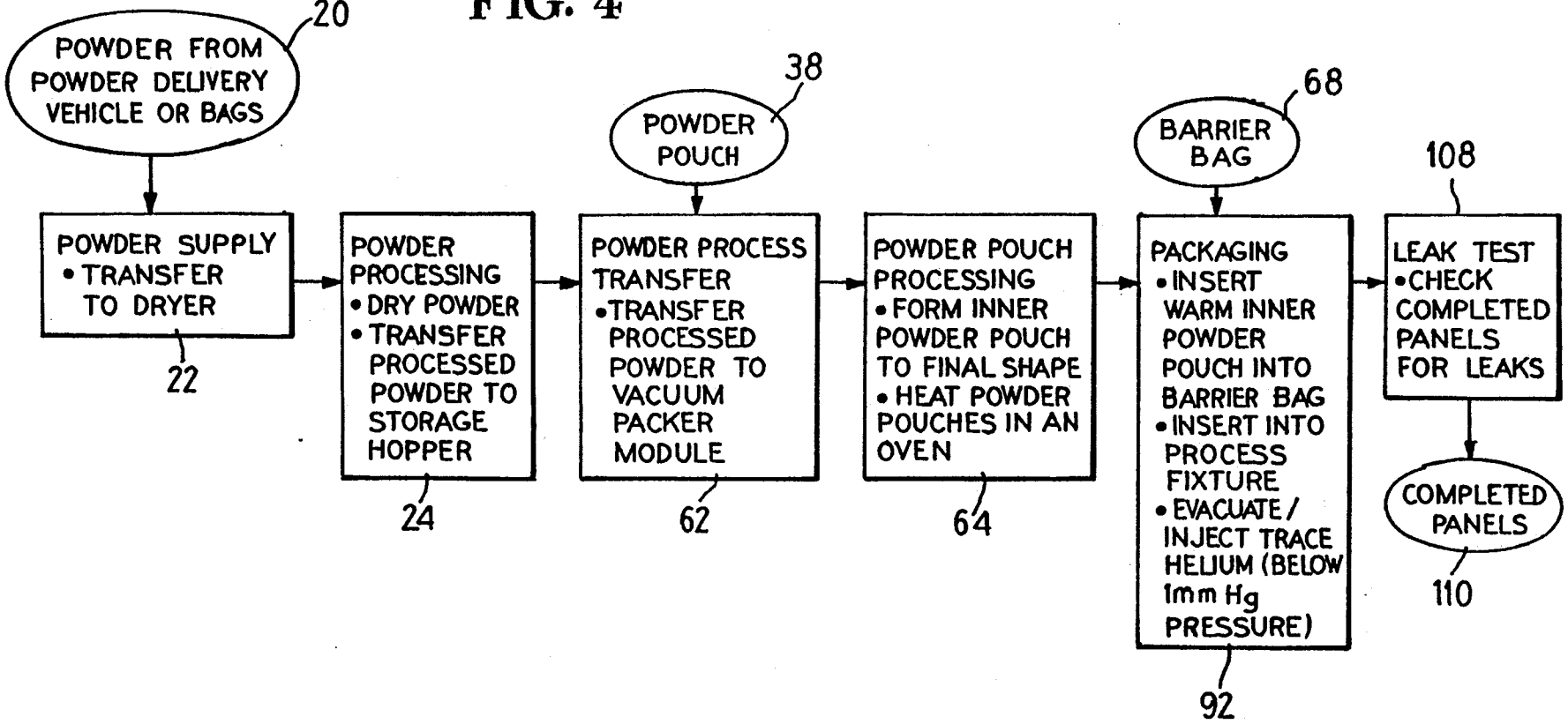
FIG. 4 is a flow chart illustrating steps utilized in the method of the present invention.

In FIGS. 1 and 4 there is illustrated a first embodiment of a method for assembling a vacuum insulation panel. In this panel, a microporous powder is used as the insulating material. Step 20 (FIG. 4) shows a step of delivery of the powder from a delivery vehicle or powder bags. The powder is delivered to a powder supply device, such as a storage hopper in step 22 or directly from bags to the drier in step 24 by using an automatic bag splitter. The powder is then dried in step 24 (FIG. 4), step 26 (FIG. 1) such as by heating and/or subjecting it to a vacuum in order to remove moisture from the powder. The heating of the powder at this stage, to remove moisture, can occur at temperatures up to 400° F. (205° C.) or higher if desired. The dry powder is then transferred to a storage hopper 60 (FIGS. 6 and 7) in step 28 (FIG. 1) where it may be maintained in a dry condition such as by storing it under a dry nitrogen (or air) blanket (to prevent reabsorption of moisture into the powder).

Figure 3A:
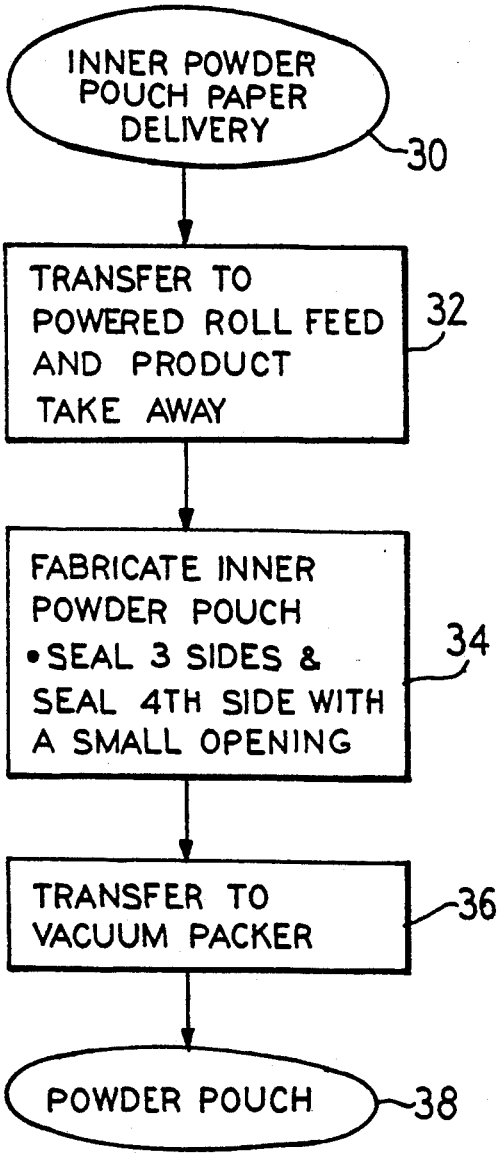
FIG. 3*a* is a flow chart schematically illustrating fabrication of the powder pouch.

The powder is then loaded into a powder pouch which has been fabricated in accordance with the steps illustrated in FIG. 3*a*. In step 30 the pouch material is delivered and in step 32 it is transferred to a powder roll feed mechanism. Step 34 illustrates fabrication of the pouch in which three sides of the pouch are sealed. Also, preferably, part of the fourth side is also sealed leaving only a small opening into the interior of the pouch. In a preferred embodiment the inner porous pouches are produced using a hot head form seal with a special fixture, leaving the small opening for the loading of the microporous powder into the pouch.

To prevent material sticking and to enable machine indexing with hot head heat sealing, a unique process technique had to be devised. The two layers of inner porous pouch films are fed into the heat sealing machine sandwiched in between two teflon cloth layers. The pouch films in between the teflon layers get melted and fused together and get trimmed without sticking to the teflon cloths.

Figure 6:
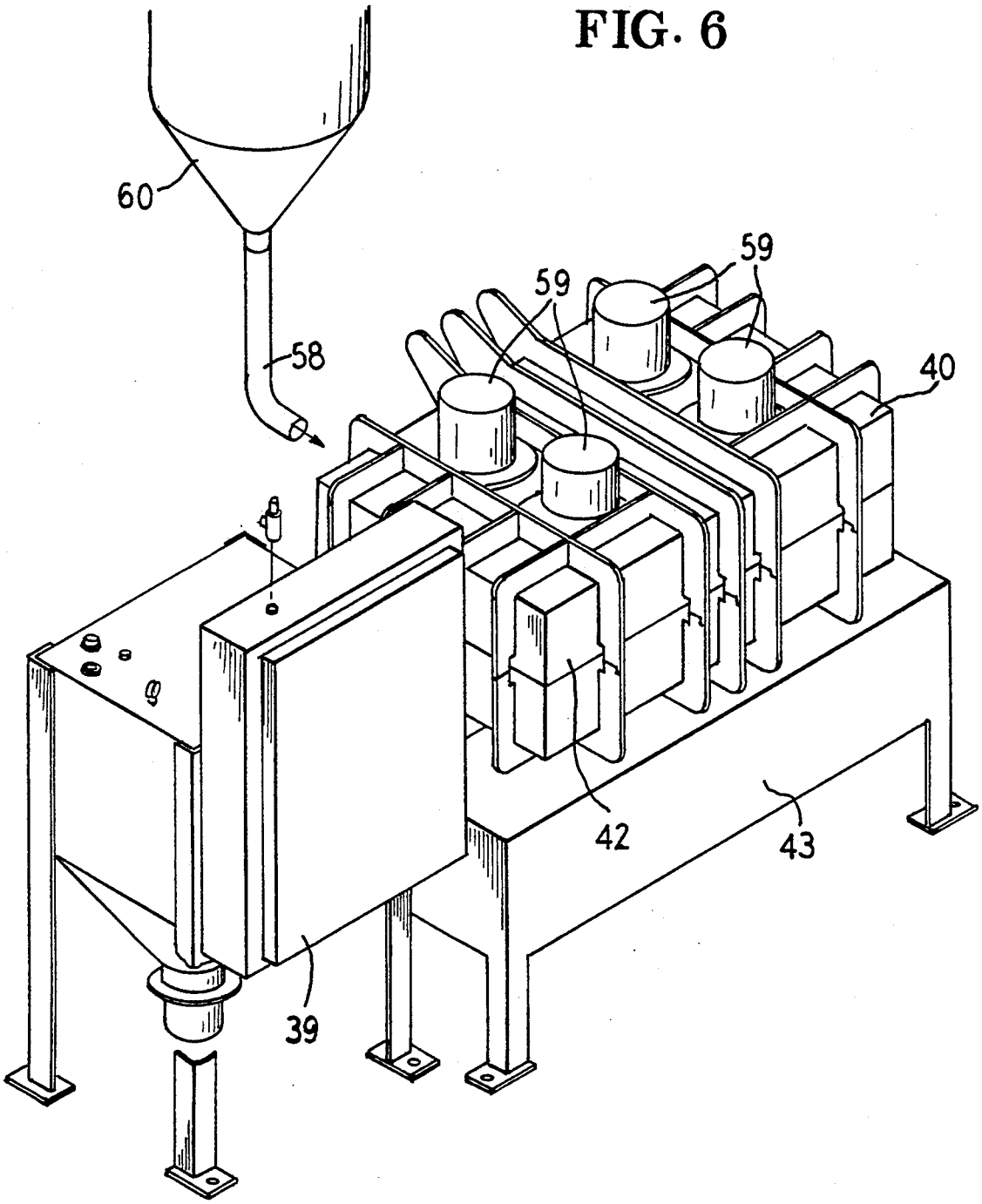
FIG. 6 is a schematic view of a vacuum filling machine used to fill the microporous pouch with insulation material and subsequently press it.

In step 36 the fabricated pouch is transferred from the pouch fabricating area as a nearly completed pouch as indicated in step 38 (FIGS. 3*a* and 4). The powder pouch is placed within a vacuum filling machine (VFM) 40 (FIG. 6). The VFM 40 consists of an exterior housing 42 which can be sealed in an air tight manner. Shown also in FIG. 6, the VFM 40 has a screw jack type 59 press system, a platform 43 with a sensitive weight scale and a microprocessor based PLC (programmable logic controlled) control system 39.

Figure 7:
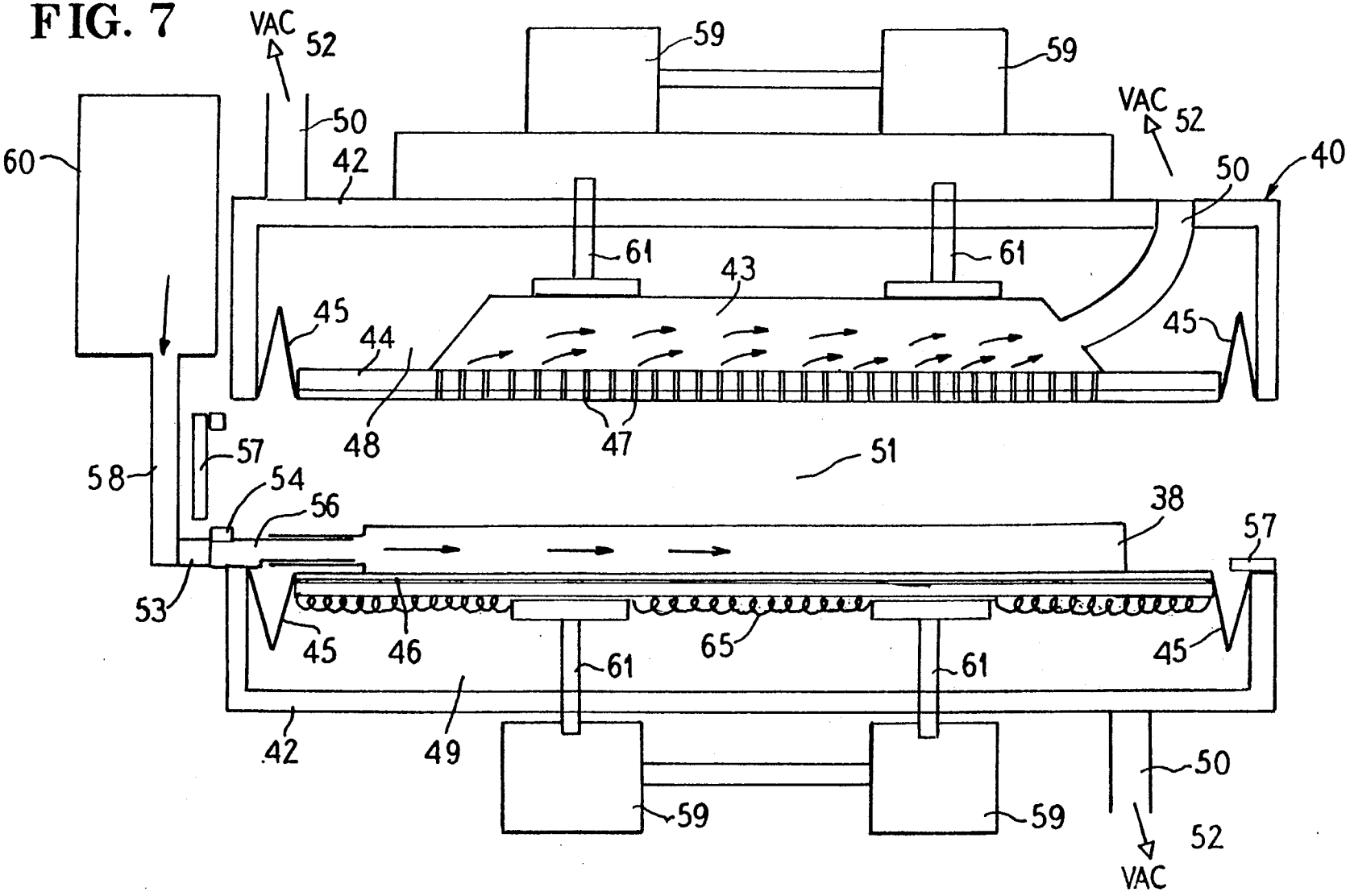
FIG. 7 is a side sectional view of the vacuum filling machine used to fill the microporous pouch with insulation material and subsequently press it.

Within the housing (as illustrated in FIG. 7) there are a perforated plate 44 (upper) and, parallel to it, a solid plate 46 (lower) between which the powder pouch 38 is placed. A vacuum hood 43 is situated above the perforated plate 44 and covers most of the surface of the plate 44. Perforations 47 extend from a front side 44*a* to a back side 44*b* of the plate 44 covering the total area underneath the vacuum hood 43. The plates 44, 46 are spaced from the housing 42 by an upper chamber 48 (facing the back side 44*b* and the vacuum hood 43) and by a lower chamber 49 (facing the back side 46*b*). Both the upper chamber 48 and the lower chamber 49 are sealed by flexible rubber seals 45 extending from the plates 44, 46 to the housing 42.

The chambers 48, 49 can be evacuated through a conduit 50 leading to a vacuum source 52. A space 51 in between the movable plates 44, 46 where the pouch 38 is located (when the upper and lower sections of the housing 42 closes) can be also evacuated through the perforations 47 via the vacuum hood 43. The vacuum hood is also evacuated through the conduit 50 leading to the same vacuum source 52. An opening 54 is provided through the housing 42 for insertion of a nozzle 56 connected to a conduit 58 (via a valve 53) leading from the storage hopper 60. The nozzle 56 extends into the opening in the pouch 38. Upon the actuation of the vacuum 52, the powder will be drawn from the hopper 60 into the interior of the pouch 38 to completely fill the pouch due to suction created in the space 51 by the vacuum hood 43 through the perforations 47. Since the chambers 48, 49 are exposed to the same vacuum source 52, the same suction pressure is created in the chambers 48, 49 and the space 51.

Once the pouch has been filled, the plates 44, 46 are moved towards one another by extension members 61 actuated by a screw-jack system 59 to compact and shape the pouch in a final form and a desired thickness and density by a pressing operation. The VFM 40 is capable of filling the powder into the porous pouches of varying thickness and sizes. The amount of powder being filled in the pouch 38 is measured by a sensitive weight scale situated on the platform 43 (FIG. 6) and regulated by a PLC controller. Once the pouch has been filled and pressed to its final form, the nozzle 56 is withdrawn from the pouch opening and the pouch opening is sealed by a heat sealer 57 (pressing can be done after heat sealing too). This step of filling the powder pouch is indicated at step 62 (FIGS. 1 and 4).

The VFM 40 can also optionally be provided with a heating element 65 on the back side of the solid plate 46, such as electric resistance elements, so that the pouch and its powder contents can be kept warmer than the standard room temperature (during filling and pressing) if the incoming powder from the hopper 60 is hot. The plate 46 can be heated to a temperature of 200°-300° F. (94°-150° C.) depending on the pouch material. Since it is relatively difficult and energy consuming to keep the conditioned powder hot in the hopper 60, the room temperature (but dried) powder is filled into the pouches in the preferred embodiment and the VFM 40 does not have the heating element 65. The post heating of the powder as indicated in step 64 is accomplished in an oven heated to a temperature of 200°-300° F. (94°-150° C.). The filled, formed and sealed powder pouches are kept in the oven for approximately 30 minutes before insertion into the barrier bags 68.

Figure 3B:
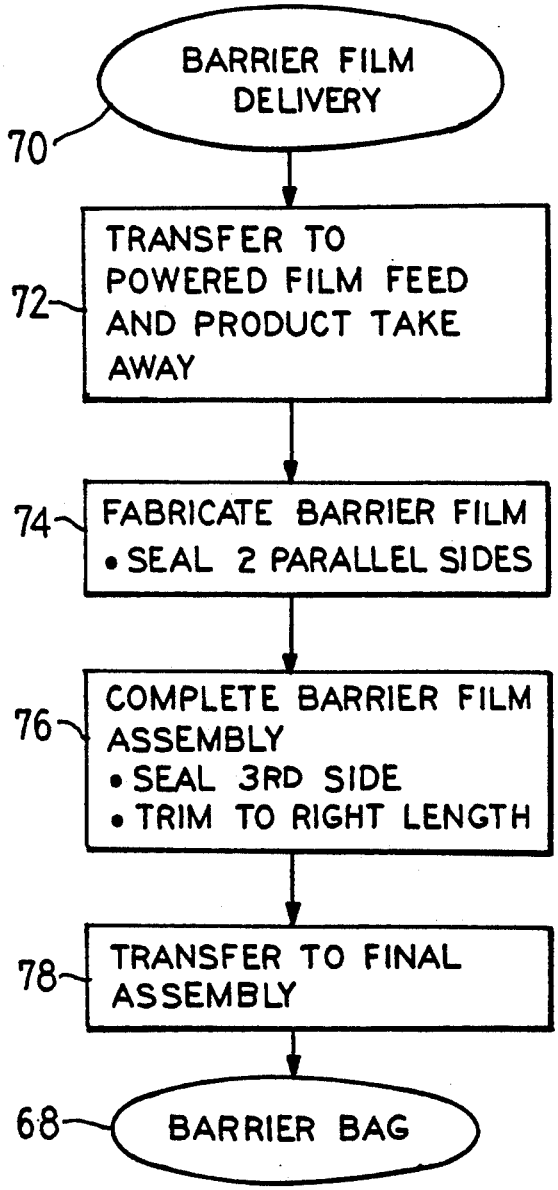
FIG. 3*b* is a flow chart schematically illustrating fabrication of the barrier bag.
Figure 8:
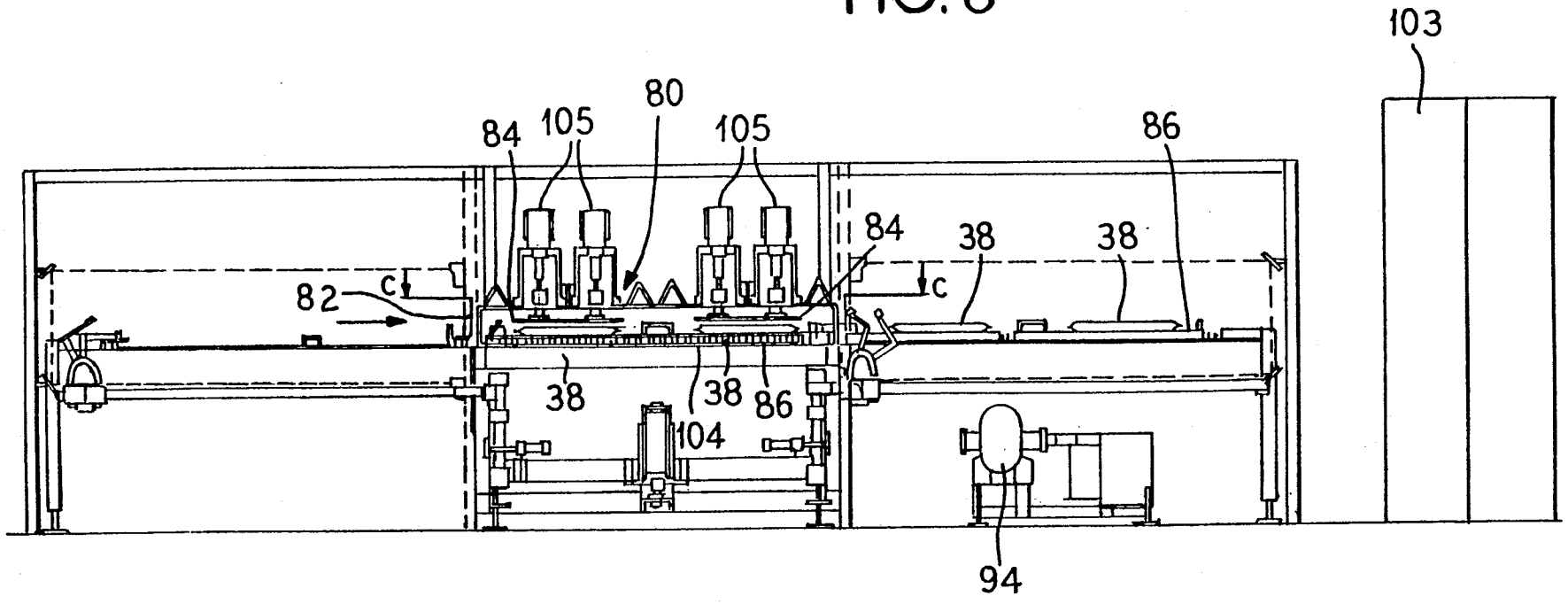
FIG. 8 is a front sectional view of the vacuum processing machine used to evacuate and seal the vacuum panel.
Figure 9:
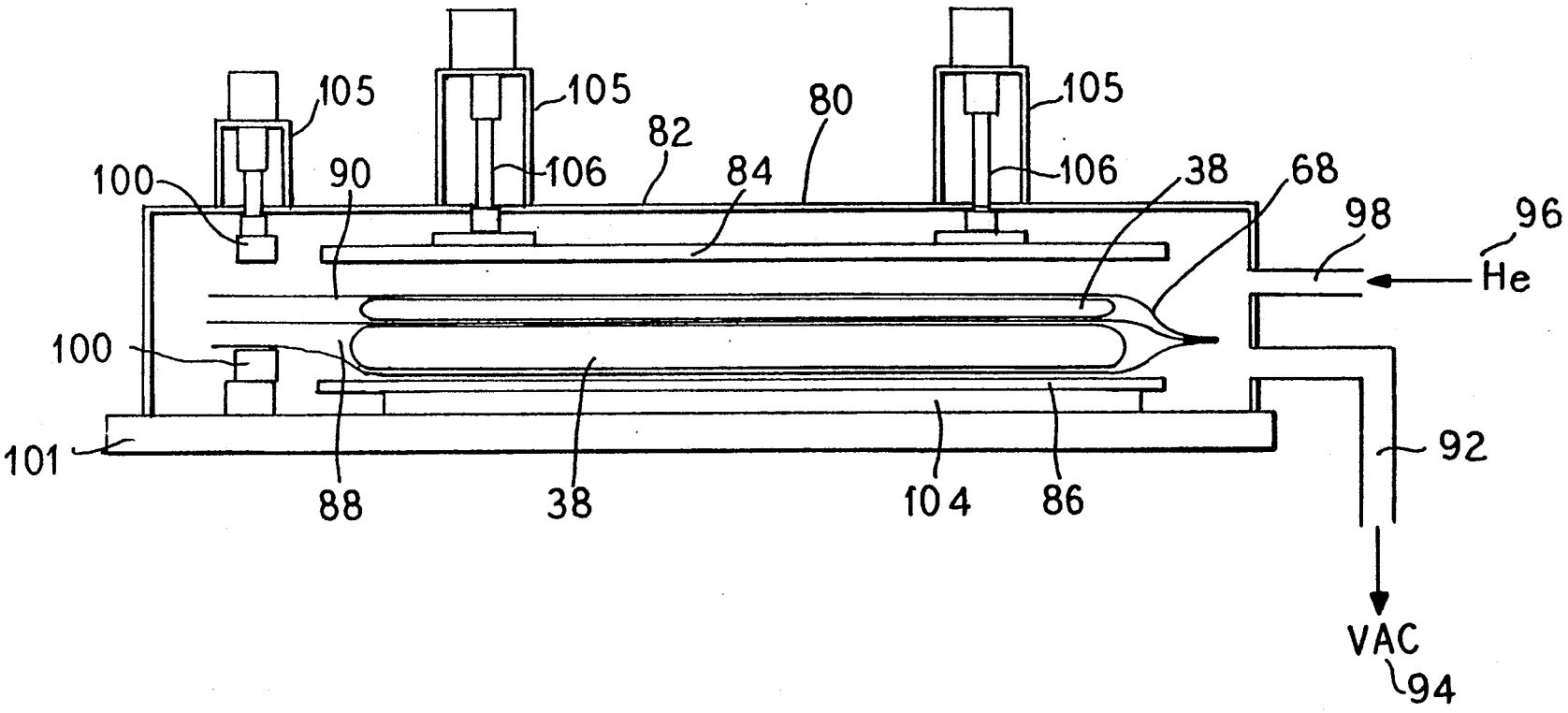
FIG. 9 is a side sectional schematic view of the vacuum processing device used to evacuate and seal the vacuum panel.

In the next step 66 (FIG. 1) the elevated temperature pouch 38 is inserted into a barrier bag which is formed in accordance with the steps illustrated in FIG. 3*b*. In step 70 the barrier film is delivered and in step 72 it is transferred to a powdered film feed and product take away. In step 74 the film is partially fabricated by sealing two parallel sides of the film. Flat impulse heat sealers are preferably used to seal the film edges together. In step 76 a third side is sealed and the barrier bag is trimmed to the right length. The fourth side of the bag is left open in order to receive the powder pouch 38. In a preferred embodiment, the bag 68 consists of two compartments which are fabricated simultaneously by heat sealing three layers of plastic barrier films (two vacuum metalized plastic films and one aluminum foil plastic laminate film) at one time. In step 78 the barrier bag 68 is transferred to a vacuum processing machine (VPM) 80 (FIG. 8). The vacuum processing machine has an exterior housing 82 which can be sealed. Interior of the housing 82 are two parallel plates 84, 86, between which the barrier bag 68 is placed (FIG. 9). The barrier bag 68 illustrated in FIG. 9 has two separate internal compartments 88, 90. A powder pouch 38 is contained within each of the compartments 88, 90.

The insertion of the pouches into the panel as indicated in step 66 (FIG. 1) and step 92 (FIG. 4) occurs while the pouches 38 are still at an elevated temperature. The interior of the VPM housing 82 is connected by means of a conduit 92 to a source of vacuum 94 so that gases can be evacuated from the interior of the housing, including from within the barrier bag 68 and the powder pouches 38 (FIG. 9). Once evacuation of the interior of the housing 82 has occurred for a sufficient length of time to achieve the desired level of vacuum, preferably, a small, discrete amount of helium (at a low pressure, e.g. 1 mm Hg or less) is injected from a helium source 96 such as by flooding the interior of the housing by means of a conduit 98. The barrier bag is then sealed closed such as by engagement of heat sealing elements 100. This vacuum processing is indicated at step 102 (FIG. 1) and 92 (FIG. 4).

After the barrier bag 68 has been sealed, the vacuum panel will be in its final form. The plates 84, 86 are moved by extension devices 106 actuated by air cylinders 105 (sealed from the interior of the housing) to press against the completed vacuum panel at a force of approximately half an atmosphere to stabilize the shape of the vacuum panel prior to reintroduction of air into the interior of the VPM housing 82. Once the panel is held in place, the vacuum is released and air is permitted to re-enter the housing 82 permitting removal of the completed vacuum panels and transfer of those panels to an area for leak testing as indicated at step 108 (FIG. 1 and FIG. 4). The panels are moved in and out the interior of the housing 82 by movable process plates 86 situated over rollers 104 (FIG. 8). Following the leak test, the panels will be complete as indicated at step 110 (FIG. 4).

Figure 2:
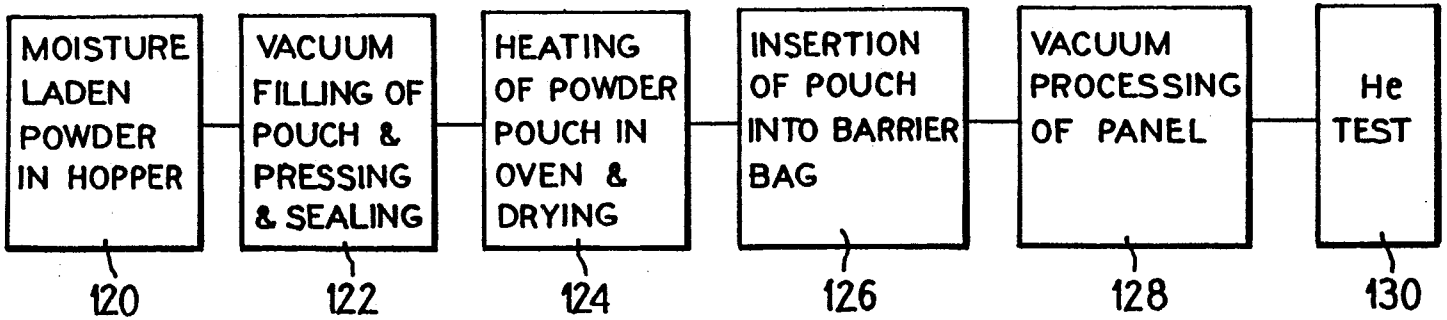
FIG. 2 is a flow chart schematically illustrating a second embodiment of the present invention.

An alternate embodiment of the method is illustrated in FIG. 2. Step 120 indicates introduction of powder to a supply hopper in a step similar to steps 20 and 22 of FIG. 4. The process then jumps immediately to vacuum filling of the pouch 38 in step 122, identical to step 62 of FIGS. 1 and 4. Step 124 indicates heating of the filled pouch in an oven, preferably a vacuum oven in order to remove moisture from the insulating material. The warm and dry pouch is then immediately inserted into a barrier bag 68 in step 126, similarly to step 66 of FIG. 1. Vacuum processing of the bag 68 occurs in step 8 identical to step 102 of FIG. 1 and the panel then moves to helium testing in step 30 identical to step 108 of FIG. 1. Thus, in this embodiment the powder is heated only once, just prior to insertion into the bag and is inserted into the pouch in a moisture laden condition rather than a dry condition as would occur in the first embodiment.

In either embodiment the insulation powder in the pouch 38 is inserted into the barrier bag 68 in a dry and elevated temperature condition in order to reduce the time required for vacuum processing of the panel and to assure a high vacuum level within the resulting panel to be achieved in a relatively short period of time.

Figure 5:
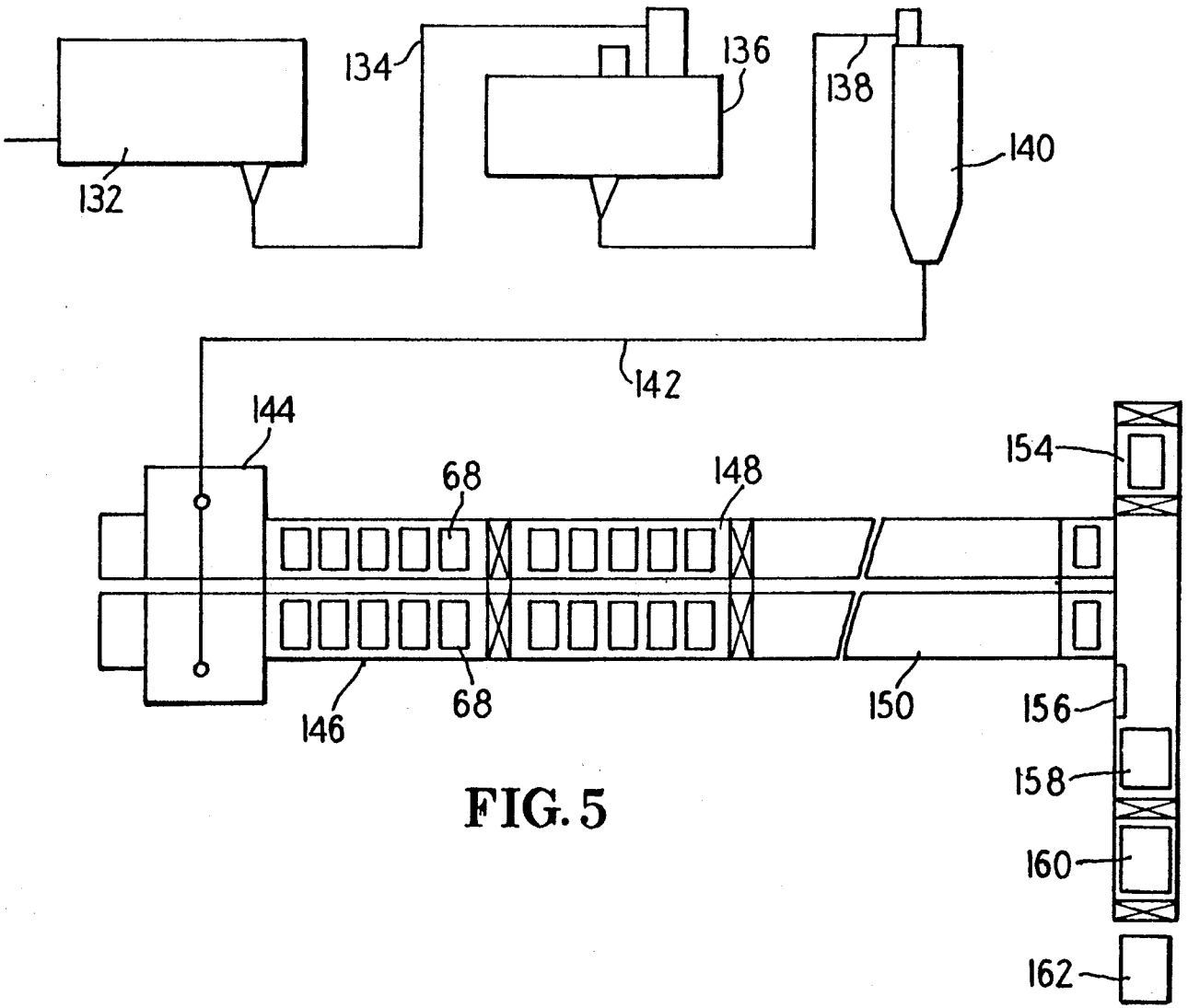
FIG. 5 illustrates an embodiment of a fabrication line utilizing the method of the present invention.

FIG. 5 illustrates a schematic equipment layout for an automated version of the process described in FIGS. 1 and 4. An automatic bag splitter 132 is used to open bags containing the insulating powder. It is also possible to bring the powder in large containers and store the powder in a storage silo. The powder is then transferred through a conduit 134 to a vacuum dryer 136 to initially dry the powder. The dried powder is then transferred through a conduit 138 to a storage hopper 140, which can be supplied with a dry nitrogen internal atmosphere. The powder is then supplied through conduit 142 to a vacuum filling machine 144. Filled pouches 38 are then carried along a conveyor to a preheating station 146 where the dry panels are raised to an elevated temperature. The pouches then move into an air lock 148 where groups of the pouches are subjected to a vacuum. The pouches, 38 then move into an evacuation chamber 150 where they remain under vacuum and at an elevated temperature while they are inserted into barrier bags 68 which have been introduced through a barrier bag air lock 154. The barrier bag is then sealed at station 156 and completed panels are accumulated at station 158 from which point they move to a leak test area 160 prior to being transferred to a completion area 162.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A method for assembling a vacuum insulation panel comprising the steps:

1) loading a quantity of microporous powder into a gas permeable pouch;
2) sealing said pouch;
3) heating said powder to a temperature elevated above standard room temperature;
4) removing moisture from said powder;
5) inserting said pouch into a gas impermeable bag while said pouch and powder remain at said elevated temperature;
6) evacuating gases from said powder pouch while it is at said elevated temperature;
7) evacuating gases from said bag; and
8) sealing said gas evacuated bag with said gas evacuated pouch therein to form a vacuum insulation panel.

2. A method according to claim 1, wherein said heating of said powder occurs both before said powder is loaded into said pouch and again just prior to insertion of said pouch into said bag.

3. A method according to claim 1, wherein said heating of said powder occurs only after said powder is loaded into said pouch.

4. A method according to claim 1, wherein said gases are evacuated from said powder and bag prior to insertion of said pouch into said bag.

5. A method according to claim 1, wherein said powder is elevated to a temperature in the range of 95°–150° C. prior to insertion into said gas impermeable bag.

6. A method according to claim 1, wherein said powder is held at said elevated temperature for a period of time in the range of 30 to 120 minutes.

7. A method according to claim 1, wherein said powder is exposed to a vacuum during the time it is heated.

8. A method according to claim 1, wherein said powder is exposed only to vacuum and dry gases after it is heated and the moisture is removed.

9. A method according to claim 1, wherein said powder is loaded into said pouch by providing a communication path from a source of said powder into said pouch and then exposing said pouch to a vacuum to draw said powder into said pouch.

10. A method according to claim 1, wherein said pouch is sealed by heat.

11. A method according to claim 1, wherein said gases are evacuated from said powder and bag subsequent to insertion of said pouch into said bag.

12. A method according to claim 1, wherein said bag is sealed by heat.

13. A method according to claim 1, wherein a trace amount of Helium having a pressure of not more than 1 mm Hg is injected into said bag after insertion of said pouch and evacuation of said gases and just prior to sealing of said bag.

14. A method according to claim 1, wherein said bag is formed with multiple inner compartments and a plurality of pouches are inserted into said bag, one for each compartment.

15. A method according to claim 1, wherein said powder pouch is pressed into a desired form and density after said pouch has been loaded with said powder.

16. A method according to claim 15, wherein said powder pouch is pressed into said desired form and density before it is sealed.

17. A method according to claim 15, wherein said powder pouch is pressed into said desired form and density after it is sealed.

18. A method according to claim 1, wherein said moisture removal occurs simultaneously with said heating of said powder, occurring before said powder is loaded into said pouch.

19. A method according to claim 1, wherein said heating of said powder and said moisture removal occur simultaneously only after said powder is loaded into said pouch.

20. A method for assembling a vacuum insulation panel comprising the steps:

1) loading a quantity of microporous powder into a gas permeable pouch;
2) sealing said pouch;
3) heating said powder to a temperature elevated above standard room temperature;
4) removing moisture from said powder;
5) inserting said pouch and dried powder into a gas impermeable bag while said pouch and powder remain at said elevated temperature;
6) evacuating gases from said powder pouch while it is at said elevated temperature;
7) evacuating gases from said bag;
8) injecting a small trace (below 1 mm Hg) of Helium at a pressure into said bag after insertion of said pouch and evacuation of said gases; and
9) immediately thereafter sealing said gas evacuated bag with said gas evacuated pouch therein to form a vacuum insulation panel.

21. A method according to claim 20, wherein said moisture removal occurs simultaneously with said heating of said powder.

22. A method according to claim 20, wherein said heating of said powder occurs both before said powder is loaded into said pouch and again just prior to insertion of said pouch into said bag.

23. A method according to claim 20, wherein said heating of said powder occurs only after said powder is loaded into said pouch.

24. A method for assembling a vacuum insulation panel comprising the steps:

1) loading a quantity of microporous powder into a gas permeable pouch via vacuum filling;
2) pressing said pouch into a desired form;
3) heat sealing said pouch;
4) heating said powder to a temperature elevated above standard room temperature;
5) removing moisture from said powder;
6) inserting said pouch and dried powder into a gas impermeable bag while said pouch and powder remain at said elevated temperature;
7) evacuating gases from said powder pouch while it is at said elevated temperature;
8) evacuating gases from said bag;
9) injecting a trace amount (below 1 mm Hg) of Helium at a pressure into said bag after insertion of said pouch and evacuation of said gases; and
10) immediately thereafter heat sealing said gas evacuated bag with said gas evacuated pouch therein to form a vacuum insulation panel.

* * * * *